US012116864B2

(12) United States Patent
Almarri et al.

(10) Patent No.: US 12,116,864 B2
(45) Date of Patent: Oct. 15, 2024

(54) COOLING INJECTION FLUID

(71) Applicant: Saudi Arabian Oil Company, Dhahran (SA)

(72) Inventors: Misfer J. Almarri, Dammam (SA); Waheed Syed Arshad, Mississauga (CA); Mohammad H. Altwaijri, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 97 days.

(21) Appl. No.: 17/949,651

(22) Filed: Sep. 21, 2022

(65) Prior Publication Data

US 2024/0093575 A1 Mar. 21, 2024

(51) Int. Cl.

| | |
|---|---|
| ***E21B 36/00*** | (2006.01) |
| ***E21B 43/16*** | (2006.01) |
| ***E21B 43/26*** | (2006.01) |
| ***E21B 43/267*** | (2006.01) |

(52) U.S. Cl.

CPC ..... *E21B 36/001* (2013.01); *E21B 43/164* (2013.01); *E21B 43/2605* (2020.05); *E21B 43/2607* (2020.05); *E21B 43/267* (2013.01)

(58) Field of Classification Search

None

See application file for complete search history.

(56) References Cited

U.S. PATENT DOCUMENTS

| | | | | |
|---|---|---|---|---|
| 3,602,310 | A | 8/1971 | Halbert | |
| 5,214,925 | A * | 6/1993 | Hoy | F04B 15/06 62/50.1 |
| 2012/0318533 | A1* | 12/2012 | Keller | E21B 41/0064 166/402 |
| 2013/0306321 | A1* | 11/2013 | Lanctot-Downs | E21B 43/26 507/260 |
| 2014/0352984 | A1* | 12/2014 | Enis | E21B 43/26 166/402 |
| 2015/0053399 | A1 | 2/2015 | Irani | |
| 2017/0276054 | A1 | 9/2017 | Shaaban et al. | |
| 2021/0363868 | A1 | 11/2021 | Almarri et al. | |
| 2023/0041084 | A1 | 2/2023 | Smith | |

FOREIGN PATENT DOCUMENTS

| | | | |
|---|---|---|---|
| CN | 112523735 | A | 3/2021 |
| CN | 113738435 | A | 12/2021 |
| EP | 2631422 | A2 | 8/2013 |

OTHER PUBLICATIONS

Bougriou et al.; Shell-and-double concentric-tube heat exchangers; Jan. 2010; Springer-Verlag; pp. 315-322 (Year: 2010).*

(Continued)

*Primary Examiner* — Anuradha Ahuja

(74) *Attorney, Agent, or Firm* — Fish & Richardson P.C.

(57) ABSTRACT

A method of fracturing a subsurface formation includes super-cooling liquid carbon dioxide to a temperature between −60° F. to −70° F. using liquid nitrogen having a temperature in a range of −100° F. to −200° F., pumping the lipid carbon dioxide down a wellbore to create fractures in the subsurface formation, and pumping fracturing fluid containing a proppant down the wellbore after pumping the liquid carbon dioxide down the wellbore.

7 Claims, 8 Drawing Sheets

(56) References Cited

OTHER PUBLICATIONS

U.S. Appl. No. 17/745,542, filed May 16, 2022, Arshad et al.
U.S. Appl. No. 17/949,626, filed Sep. 21, 2022, Almarri et al.
"Accu-Freeze—Automatically Controlled Liquid Nitrogen Pipe Freezing System—Cryogenic Freeze Seal Jackets," Huntingdon Fusion Techniques, Nov. 2018, 1 page.
"Accu-Freeze—Automatically Controlled Liquid Nitrogen Pipe Freezing System," Huntingdon Fusion Techniques, Feb. 2017, 2 pages.
"Accu-Freeze—Automatically Controlled Liquid Nitrogen Pipe Freezing System," Huntingdon Fusion Techniques, Jan. 2016, 1 page.
"Accu-Freeze—Automatically Controlled Liquid Nitrogen Pipe Freezing System—Frequently Asked Questions" Huntingdon Fusion Techniques, Dec. 2015, 1 page.
Almarri, "Efficient History Matching of Thermally Induced Fractures Using Coupled Geomechanics and Reservoir Simulation," Energies, Jun. 2020, 13(11):3001, pp. 21-43.
Almarri, "Identification and characterization of Thermally Induced Fractures through integrated analytical and semi-analytical models," Journal of Petroleum Science and Engineering, Jan. 2021, 196:107930, 20 pages.
Al-Nakhli et al., "Reducing Breakdown Pressure of Tight Reservoirs Via in-Situ Pulses: Impact of Mineralogy," SPE/IATMI Asia Pacific Oil & Gas Conference and Exhibition, Oct. 2019, 12 pages.
Altammar et al., "Application of Different Fluid Injection Methods to Reduce Breakdown Pressure," International Petroleum Technology Conference, Jan. 2020, 14 pages.
Briner et al., "Impact of Wellbore Completion Type on Fracture Initiation Pressure in Maximum Tensile Stress Criterion Model for Tight Gas Field in the Sultanate of Oman," International Petroleum Technology Conference, Dec. 2015, 12 pages.
Chavez et al., "Formation Breakdown Prediction for the Implementation of Hydraulic Fracturing on a HPHT Tight Gas Reservoir in Oman," SPE Unconventional Gas Conference and Exhibition, Jan. 201310.2118/164012-MS, 8 pages.
Farid Ibrahim et al., "Evaluation of the Breakdown Pressure to Initiate Hydraulic Fractures of Tight Sandstone and Shale Formations," SPE Trinidad and Tobago Section Energy Resources Conference, Port of Spain, Jun. 2018, 19 pages.
fourquest.com [online], "Pipefreezing," 2022, retrieved on May 5, 2022, retrieved from URL <https://www.fourquest.com/nitrogen-services/pipe-freezing/>, 7 pages.
Gomaa et al., "New Insights into Hydraulic Fracturing of Shale Formations," International Petroleum Technology Conference, Jan. 2014, 17 pages.
Oparin et al., "Impact of Local Stress Heterogeneity on Fracture Initiation in Unconventional Reservoirs: A Case Study from Saudi Arabia." SPE Annual Technical Conference and Exhibition, Sep. 2016, 18 pages.
Sakhaee-Pour et al.,, "Predicting Breakdown Pressure and Breakdown Cycle in Cyclic Fracturing," SPE Production & Operations, Jun. 2018, 33(04):761-769, 9 pages.
Trichel et al., "Understanding and Managing Bottom Hole Circulating Temperature Behavior in Horizontal HT Wells—A Case Study Based on Haynesville Horizontal Wells," Presented at the SPE/IADC Drilling Conferenced and Exhibition, Amsterdam, The Netherlands, Mar. 1-3, 2011; SPE/IADC 140332, SPE International, 20 pages.
Vilarrasa et al., "Impacts of thermally induced stresses on facture stability during geological storage of CO2," Energy Procedia, Jan. 2016, 86:411-419, 9 pages.
Wikipedia.com [online], "Supercooling," Apr. 2022, retrieved on May 5, 2022, retrieved from URL <https://en.wikipedia.org/wiki/Supercooling>, 9 pages.

* cited by examiner

COOLING INJECTION FLUID

TECHNICAL FIELD

This disclosure relates to injecting cooled fluids into a hydrocarbon formation, especially super-cooled fluids.

BACKGROUND

Hydraulic fracturing is a well stimulation technique involving the fracturing of bedrock formations by a pressurized liquid. The process involves the high-pressure injection of fracking fluid, such as water containing sand or other proppants, into a wellbore and creating cracks/fractures in the deep-rock formations. These fractures serve as conduits for allowing the hydrocarbon trapped in the reservoir to flow easily to the surface, especially in tight rock formations. When the hydraulic pressure is removed from the well, the created fractures tend close but by introducing proppants during the fracturing treatment into these fractures help to keep them propped up thus maintaining a sustained production capability from the reservoir.

SUMMARY

This disclosure describes methods and systems for cooling a fluid on surface and injecting the fluid down the well for effective hydraulic fracturing and making commercially productive wells. Fluids are injected into a hydrocarbon formation to hydraulically fracture the hydrocarbon formation. In some cases, fracturing a hydrocarbon formation can be difficult, for example, in tight, hard rock formations. The hydraulic pressure required to break down the formation in such cases can exceed the pressure rating of the tubulars thus making it impossible to fracture the tight rock and produce from it commercially. One method of reducing the breakdown pressure is by injecting a cold liquid into the hot, hydrocarbon formation to create a thermal shock in the reservoir which helps lessen the in-situ stress of the reservoir and decrease the breakdown pressure. Reducing the breakdown pressure increases hydraulic fracturing effectiveness and its efficiency.

In a first aspect, a method of fracturing a subsurface formation includes super-cooling liquid carbon dioxide to a temperature between −60° F. to −70° F. using liquid nitrogen having a temperature in a range of −100° F. to −200° F., as a heat exchanging medium, pumping the liquid carbon dioxide down a wellbore to create fractures in the subsurface formation, and pumping fracturing fluid containing a proppant (or other forms of conductivity generating materials, such as acid) down the wellbore after pumping the liquid carbon dioxide down the wellbore.

In some embodiments, super-cooling the liquid carbon dioxide includes flowing the carbon dioxide through an in-line heat exchanger, the inline heat exchanger including at least one inner tube fluidly connected to the tubing, a middle tube disposed around the inner tube, first end walls extending between the inner tube and the middle tube, the first end walls, the inner tube, and the middle tube defines a sealed chamber, an outer tube extending around the middle tube, the outer tube having an upstream end and a downstream end, and second end walls extending between the outer tube and the middle tube, the second end walls, the outer tube, and the middle tube defining a jacket chamber with an inlet at the upstream end of the outer tube and an outlet at the downstream end of the outer tube.

In some embodiments, the method includes holding the liquid carbon dioxide in a chilled holding tank fluidly connected to the in-line heat exchanger after super-cooling the liquid carbon dioxide.

In some embodiments, the method includes continuing to cool the liquid carbon dioxide within the chilled holding tank.

In some embodiments, the method includes circulating the liquid carbon dioxide repeatedly between the in-line heat exchanger and the chilled holding tank.

In some embodiments, the liquid carbon dioxide is maintained at a surface pressure in a range of 60 psi to 100 psi.

The details of one or more embodiments of these systems and methods are set forth in the accompanying drawings and description below. Other features, objects, and advantages of these systems and methods will be apparent from the description, drawings, and claims.

This disclosure describes methods and systems for cooling a fluid on surface and injecting the fluid down a well for effective hydraulic fracturing. The disclosure is presented to enable any person skilled in the art to make and use the disclosed subject matter in the context of one or more particular implementations. Various modifications to the disclosed implementations will be readily apparent to those skilled in the art, and the general principles defiled in this application may be applied to other implementations and applications without departing from scope of the disclosure. Thus, the present disclosure is not intended to be limited to the described or illustrated implementations, but is to be accorded the widest scope consistent with the principles and features disclosed in this application.

The present systems and methods advantageously reduce the high breakdown pressures of hydrocarbon formations. For example, a liquid is super-cooled and then injected into the hot, hydrocarbon formation which creates a large temperature contrast within the reservoir thus inducing a thermal shock. The induced thermal shock reduces in-situ stress and hence the breakdown pressure of the hydrocarbon formation. This reduces the required breakdown pressures, which otherwise may exceed pumping limitations or tubular pressure ratings, of deep, tight gas reservoirs. Reducing the breakdown pressure allows the high pressured, hard rock formations to be fractured effectively. Also, the systems described can provide a super-cool liquid while being cost effective and easy to install in contrast to cooling systems which do not provide "super-cooled" fluids for hydraulic fracturing initiation.

DETAILED DESCRIPTION

Figure 1:
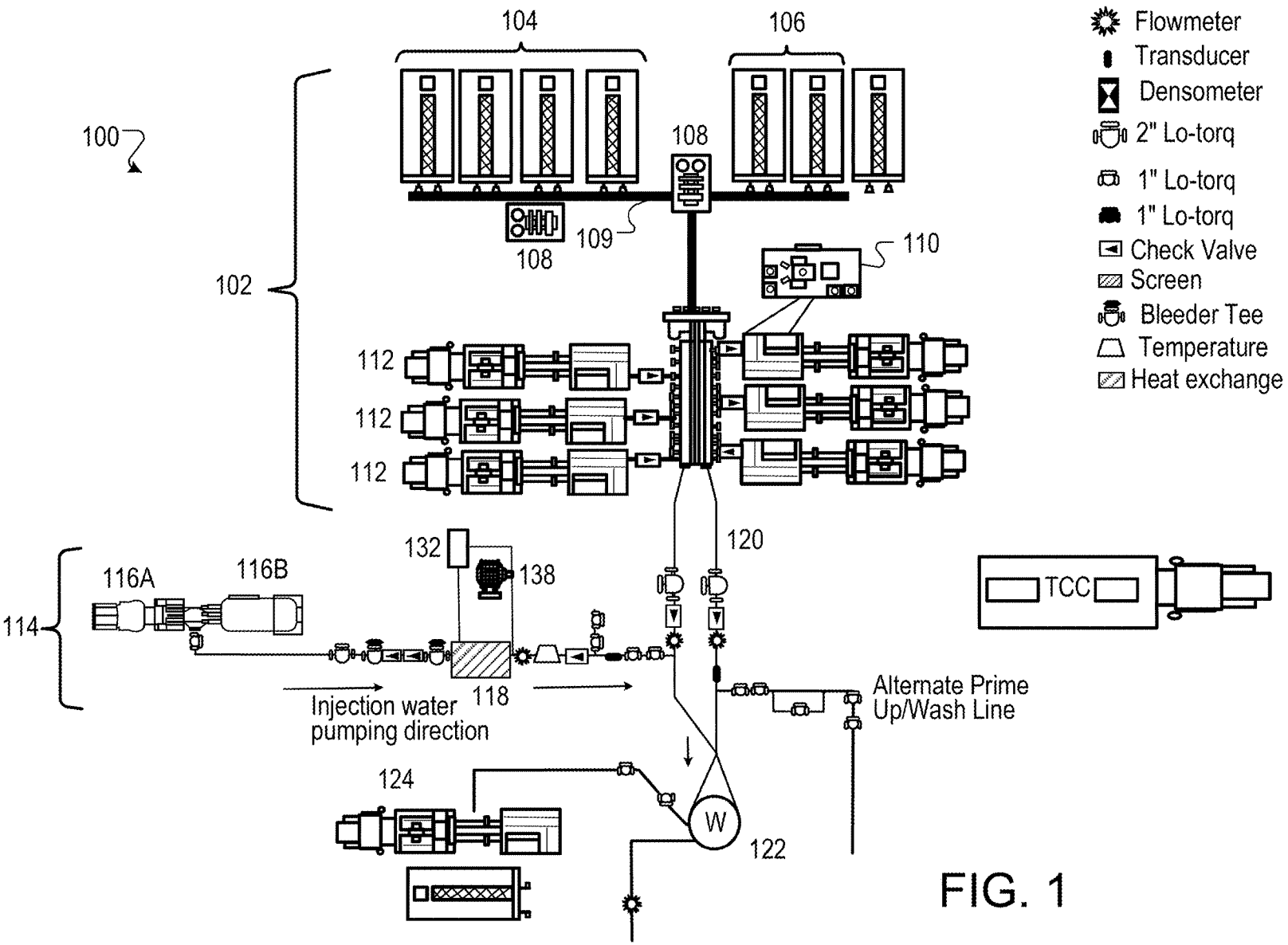
FIG. 1 illustrates a layout of hydraulic fracturing equipment spread on location.

FIG. 1 illustrates a hydraulic fracturing system 100. The fracturing system 100 includes a hydraulic fracturing subsystem 102, including fracturing tanks 104, fresh water tanks 106, boost pumps 108, a batch mixer 110, and fracturing pumps 112. The fracturing tanks 104 store chemicals, such as gellants, acids, corrosion inhibitors, and friction reducers, which can be mixed with water stored in the fresh water tanks 106 to create fracturing fluid. The batch mixer 110 can mix the water stored in the fresh water tanks with a proppant, for example, sand. Tubing 120 extends from the hydraulic fracturing subsystem 102 into a wellbore 122. For example, the tubing 120 can include pipes, such as pipes constructed of steel, carbon fiber, or another suitable material, and valves to fluidly connect the hydraulic fracturing subsystem 102 to the wellbore 122. The valves allow for control over the fluids being pumped through the tubing. The fracturing tanks 104 and the fresh water tanks 106 are connected to the boost pumps 108 by a header 109. The boost pumps 108 pump water and chemicals from the fracturing tanks 106 and the fresh water tanks 106 towards the fracturing pumps 112. The water, chemicals, and proppants are mixed to create fracturing fluid. The fracturing pumps 112 pump the fracturing fluid through the conduit 120 into the wellbore 122.

The formation breakdown setup using a cryogenic heat exchanger and its own high pressure injection pump is a self-contained fracturing system 114. This system is proposed to be used as a formation breakdown initiator which can be followed up by the main fracturing equipment setup 100.

The formation breakdown system 114 includes a high pressure pumping unit 116A with a cold fluid storage tank 116B and an in-line cryogenic heat exchanger (CHE) 118. The cold liquid subsystem 114 is plumbed to the wellbore with surface treating pipe 120 so that fluid, such as liquid carbon dioxide or water, is pumped through the in-line heat exchanger 118 to super-cool the fluid. The super-cooled fluid is then pumped into the wellbore 122.

In some embodiments, the fluid that flows through the cold liquid sub-system is liquid carbon dioxide. For example, the fluid storage tank 116B contains liquid carbon dioxide, which is pumped through the in-line heat exchanger to cool the carbon dioxide to a range of −60° F. to −70° F. at a surface pressure in a range of 60 to 100 psi.

In some embodiments, the fluid that flows through the cold liquid sub-system is water. For example, the fluid storage tank 116B contains water, which is pumped through the in-line heat exchanger to cool the water to a range of −4° F. to −30° F. This range is sufficient to deliver the water to the bottom hole of the well at a temperature below about 32° F.

The cooled or super-cooled fluid that is provided by the cold liquid subsystem 114 can provide a thermal shock to the hydrocarbon formation, lowering the minimum horizontal stress and breakdown pressure required to initiate fracture the formation. In effect, the cooling will ultimately decrease breakdown pressure so fractures can be initiated within the pump and tubular limitations.

The temperature of the injection fluid can be controlled at a desired temperature to reduce pipe failures. Pumping an extremely cold liquid downhole can cause failures in pipes that are made of carbon steel. For example, temperatures below −100° C. can cause pipe embrittlement and can cause failures during pumping, when pressures in the pipes can be above about 500 psi. In the heat exchanger 118, the cryogenic working fluid is used for super-cooling the injection fluid and is not pumped downhole. The injection fluid can reach temperatures of, for example, −4° F. to −70° F., which is cold enough to lower the required pressure to initiate a fracture but not cold enough to create failures in pipes.

Figure 2:
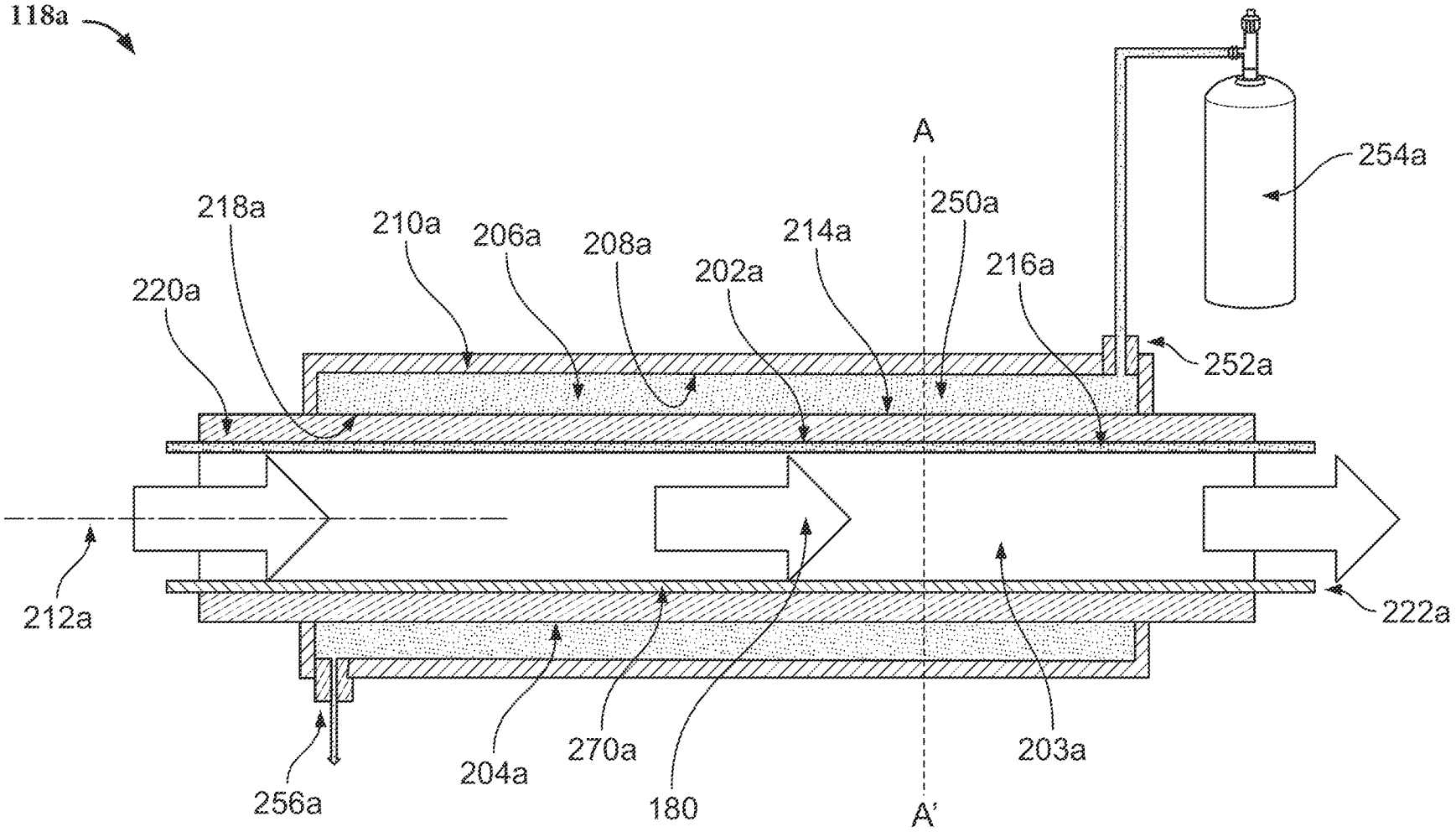
FIG. 2 is a schematic illustrations of a cryogenic heat exchange system in accordance with an embodiment of the present disclosure.
Figure 3:
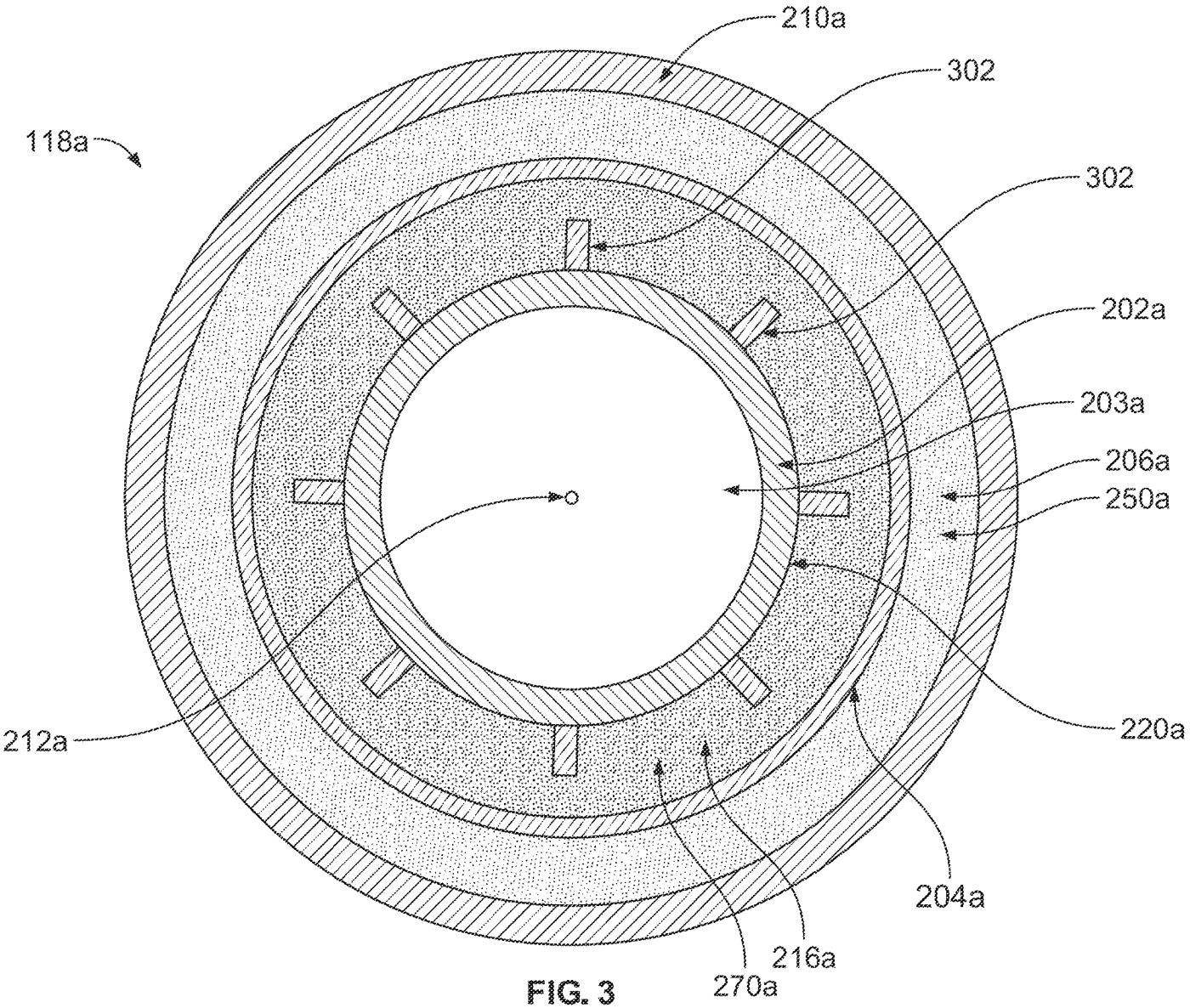
FIG. 3 is a cross-sectional schematic illustrations of a cryogenic heat exchange system in accordance with an alternative embodiment of the present disclosure.
Figure 4:
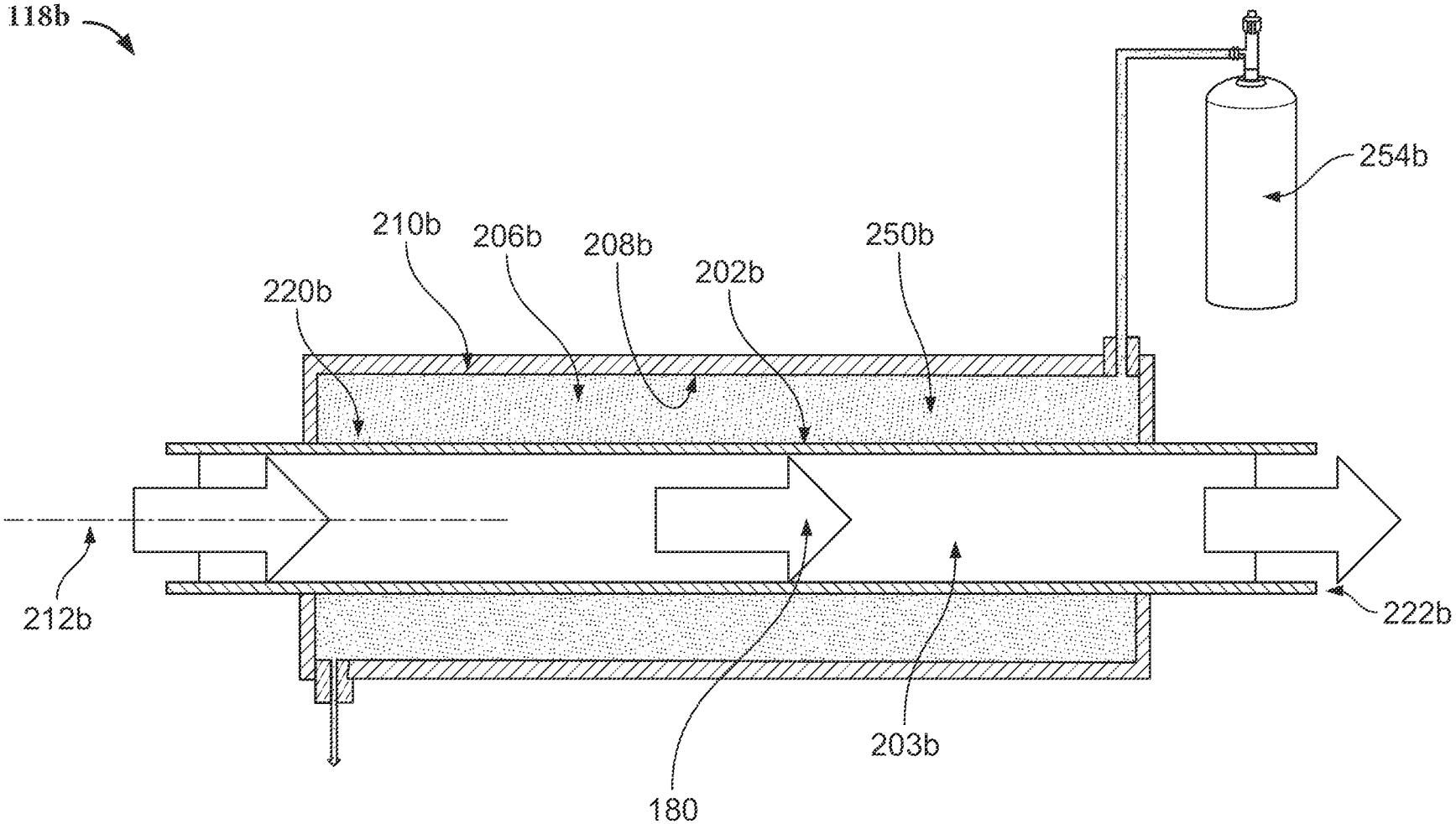
FIG. 4 is a schematic illustrations of a cryogenic heat exchange system in accordance with an alternative embodiment of the present disclosure.
Figure 5:
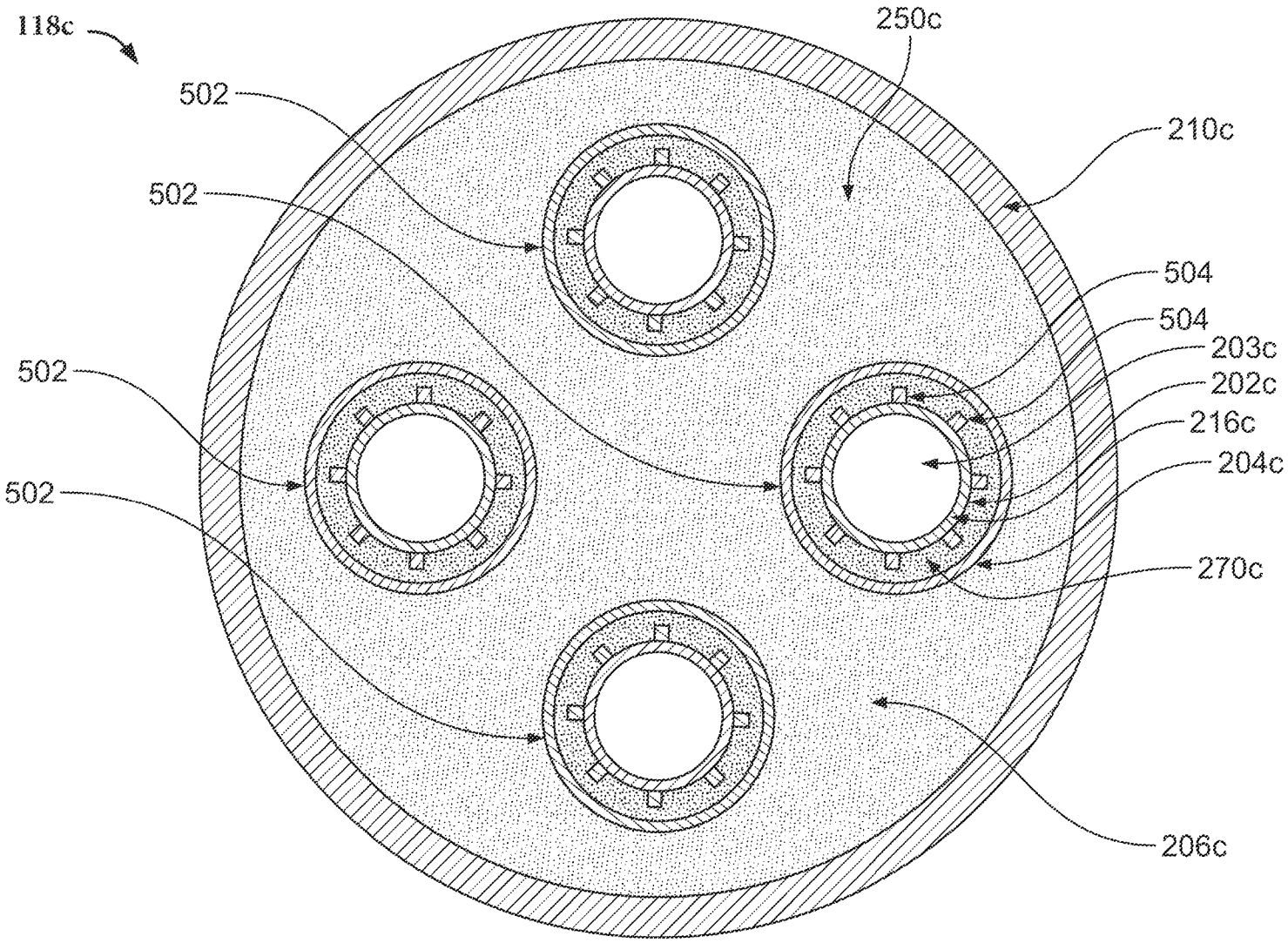
FIG. 5 is a schematic illustrations of a cryogenic heat exchange system in accordance with an alternative embodiment of the present disclosure.

In various embodiments of the present disclosure, CHE 118 can be or can include, for example, CHE 118*a* as described in reference to FIGS. 2 and 3, CHE 118*b* as described in reference to FIG. 4, or CHE 118*c* as described in reference to FIG. 5 with some or all of the features described therein, alone or in combination.

In the illustrated embodiment, CHE system 118 is located at a surface location separate from (for example, a surface distance from) wellbore 122. In some embodiments, the surface distance is about 50 feet; in other embodiments, the surface distance can be a greater or lesser distance.

In some embodiments, CHE 118 is a transportable unit. For example, if wellbore fracking system 100 is for fracking a wellbore at, for example, a first wellsite, CHE 118 can be configured to be disconnected and transported as a unit from wellbore fracking system 100 to another, separate wellbore fracking system frocking a separate wellbore at, for example a second wellsite.

In some situations, the in-line heat exchanger may not provide sufficient time for heat transfer to super-cool the injection fluid to the correct temperature range. In such cases, the injection fluid can be circulated through the heat exchanger into an insulated or chilled holding tank. When the injection fluid reaches a desired temperature, the injection fluid can be drawn in by the fracturing pumps and pumped directly into the wellbore to deliver the desired temperature to the hydrocarbon formation.

The formation breakdown system 114 can include an insulated tank 132 and a recirculation pump 138 for cooling the fluid further, if the in-line heat exchanger does not provide sufficient time for heat transfer to super-cool the injection fluid to the correct temperature range. CHE 118 flows cooled fluid to insulated tank 132. Insulated tank 132 can in some embodiments include temperature and other fluid measurement sensors and can be controlled by a control system.

FIG. 2 is a schematic illustration of a CHE system in accordance with an embodiment of the present disclosure, for cooling a fluid (for example, cooling fluid in the fracking system 100 of FIG. 1). Referring to FIG. 2, CHE system 118*a* includes a cooling fluid conduit 202*a* (which includes a central bore 203*a* through which cooling fluid 180 flows) and an intermediate tubular 204*a*, both of which are disposed within an interior volume 206*a* defined (at least partially) by an inner surface 208*a* of an outer jacket 210*a*. It will be understood that outer jacket 210*a* may not be the outermost surface of the CHE system, and that a cover or other component (not shown) may form the outer surface of the CHE system and that outer jacket 210*a* may be disposed within such a cover or other component. In the illustrated embodiment, cooling fluid conduit 202*a*, intermediate tubular 204*a*, and outer jacket 210*a* are substantially cylindrical and are coaxial and concentric. That is, cooling fluid conduit 202*a* is disposed within intermediate tubular 204*a*, which is in turn disposed within outer jacket 210*a*, and each share the same central axis 212*a*. In other embodiments, cooling fluid conduit 202*a*, intermediate tubular 204*a*, and outer jacket 210*a* can be other than substantially cylindrical and can be other than coaxial or concentric. In the embodiment shown in FIG. 2, interior volume 206*a* is further defined by an outer surface 214*a* of intermediate tubular 204*a*, and an annular volume 216*a* is defined at least partially by an inner surface 218*a* of intermediate tubular 204*a* and an outer surface 220*a* of cooling fluid conduit 202*a*. In the illustrated embodiment, interior volume 206*a* and annular volume 216*a* are closed volumes that are sealed so as to not permit any flow of fluid into or out of them, except for fluid flow permitted through one or more inlet ports or outlet ports which may be disposed on or though the walls of outer jacket 210*a* and intermediate tubular 204*a*, respectively. In other embodiments, the outer jacket and/or the intermediate tubular may be otherwise configured with respect to fluid flow within, out of, or into them. In some embodiments, other cryogenic cooling components (such as the Accu-Freeze freezing system from Huntingdon Fusion Technologies) can be include instead of or in addition to the components herein described.

In the illustrated embodiment, liquid nitrogen 250*a* can be injected into interior volume 206*a* through an inlet port 252*a* by an injection system 254*a*, such that the liquid nitrogen 250*a* fills or substantially fills interior volume 206*a*. Cooling fluid 180 pumped from the storage tank 116B and passing through cooling fluid conduit 202*a* can be cooled by heat exchange with liquid nitrogen 250*a* across a wall 222*a* of cooling fluid conduit 202*a*, prior to the cooling fluid 180 being pumped back recirculated for additional cooling as described above with respect to FIG. 1. Injection system 254*a* can, in some embodiments, include a liquid nitrogen storage tank, a cryogenic pumper, plumbing for pumping liquid nitrogen, temperature measurement devices (e.g. thermocouples), recording systems, automatic temperature controllers, and other suitable components, depending on the plumbing lines used on the rig and applicable heat transfer requirements on case-by-case basis. Excess liquid nitrogen can exit interior volume 206*a* via outlet port 256*a*. In some embodiments, injection system 254*a* is a component of CHE 118*a* and can be transported together as a unit. In other embodiments, injection system 254*a* is a component of a well system separate from CHE system 118*a*.

In the illustrated embodiment, annular volume 216*a* can be at least partially filled with water 270*a*. The cooling of cooling fluid 180 by heat exchange with the liquid nitrogen 250*a* across the wall 222*a* can include cooling the cooling fluid 180 by heat exchange with the water 270*a*, with the water 270*a* in turn being cooled by heat exchange with the liquid nitrogen 250*a*. In some embodiments, water 270*a* can sufficiently cooled by liquid nitrogen such that water 270*a* is in a solid (ice) state as the cooling fluid 180 flows through cooling fluid conduit 202*a*. In some embodiments, the CHE system of the present disclosure can provide water in the annular volume 216*a* at temperatures below 32° F. on surface. The heat exchanger will be available to deliver water in the temperature range of −4° F. to −30° F. which should be a significant improvement over the use of water chillers. Water 270*a* can act as a buffer between the liquid nitrogen and the cooling fluid and can, in some embodiments, afford better control of the heat exchange process than if no water buffer were present.

FIG. 3 is a schematic illustration of CHE system 118*a* of FIG. 2, shown in a cross-sectional view along A-A' as shown in FIG. 2, in accordance with an embodiment of the present disclosure, showing the coaxial and concentric relationship of cooling fluid conduit 202*a* (having central bore 203*a*) which is disposed within intermediate tubular 204*a* (enclosing volume 216*a* filled with water 270*a*) which is in turn disposed within outer jacket 210*a* (enclosing volume 206*a* filled with liquid nitrogen 250*a*), with each sharing a central axis 212*a*, as described above in reference to FIG. 2. In the illustrated embodiment, eight fins 302 are disposed circumferentially about, and extend from, outer surface 220*a* of cooling fluid conduit 202*a*. Fins 302*a* can increase the rate of heat exchange between the cooling fluid and the liquid nitrogen and/or water layers. Other embodiments may include no such fins or may include a greater or lesser number of fins.

FIG. 4 is a schematic illustration of a CHE system in accordance with an alternative embodiment of the present disclosure. Drilling fluid conduit 202*b* (which includes a central bore 203*b* through which cooling fluid flows) is disposed within an outer jacket 210*b*, (similar to cooling fluid conduit 202*a* and outer jacket 210*a* of FIG. 2) and each share a same central axis 212*b*. Likewise, CHE system 118*b* includes injection system 254*b* for injecting liquid nitrogen 250*b* (corresponding to injection system 254*a* and liquid nitrogen 250*a* of FIG. 1). Interior volume 206*b* of CHE system 118*b* is defined (at least partially) by inner surface 208*b* of outer jacket 210*b* and outer surface 220*a* of cooling fluid conduit 202*b*. In contrast to CHE system 118*a* of FIG. 2, liquid nitrogen 250*b* (injected by into volume 206*b* by injection system 245*b*) is in direct contact with the outer surface 220*b* of a wall 222*b* of the cooling fluid conduit 202*b*, as there is no intermediate tubular defining a water-filled annular volume. Such direct contact can increase the rate of heat exchange between the liquid nitrogen and cooling fluid 180. In some embodiments, having the liquid nitrogen in direct contact with outer surface 220 of the cooling fluid conduit can provide faster cooling of the drilling fluid than the configuration shown in FIGS. 2 and 3, in situations where a water buffer is not necessary or advantageous. It will be understood that the phrase "cooled by heat exchange with the liquid nitrogen across a wall of the cooling fluid conduit" can include (but is not necessarily limited to) either a configuration such as in FIG. 2 where the liquid nitrogen is not in direct contact with the outer surface of the cooling fluid conduit and the cooling fluid is cooled by heat exchange with an intermediate volume of water (with the water in turn being cooled by heat exchange with the liquid nitrogen), or a configuration such as FIG. 4, where the liquid nitrogen is in direct contact with the outer surface of the cooling fluid conduit.

FIG. 5 is a schematic illustration of a CHE system in accordance with an alternative embodiment of the present disclosure. Specifically, FIG. 5 is a cross-sectional view of a CHE system 118*c* which can include the same components and structure as system 118*a* of FIG. 2 except that, in contrast to CHE system 118*a*, CHE system 118*c* includes a plurality of flow conduit assemblies 502 within an outer jacket 210*c*. Each flow conduit assembly 502 includes a cooling fluid conduit 202*c* including a central bore 203*c* through which drilling fluid (such as drilling fluid 180 of FIG. 1) can flow. In the illustrated embodiment, each flow conduit assembly further includes an annular volume 216*c* defined (at least partially) by an interior surface of the intermediate tubular 204*c* and filled with water 270*c* (similar to the arrangement for annular volume 216*a* and intermediate tubular 204*a* as described above with respect to FIG. 2). Each flow conduit assembly is disposed within interior volume 206*c* filled with liquid nitrogen 250*c* and defined (at least partially) by the inner surface of outer jacket 210*c*. Having such a plurality of cooling fluid conduits (as opposed to merely a singular drilling fluid conduit) can, in some embodiments, increase the rate of heat exchange between the liquid nitrogen and the cooling fluid. In other embodiments, some or all of the plurality of fluid conduit assemblies do not include the intermediate tubular or water-filled annular volume and instead have direct contact between the liquid nitrogen and the outer surface of the cooling fluid conduits. In the illustrated embodiment, a plurality of fins 504 are disposed circumferentially about each of the cooling fluid conduit 202*c*, similar to fins 302 as described in reference to FIG. 3. Other embodiments may include no such fins or may include a greater or lesser number of fins.

Any combination of the heat exchangers described above can be placed in-line in the cold liquid subsystem so that injection fluid is pumped from the storage tank directly to the well while being cooled by the heat exchanger directly in the flow path. In some embodiments, multiple heat exchangers can be placed in-line to cool the injection fluid.

Figure 6:
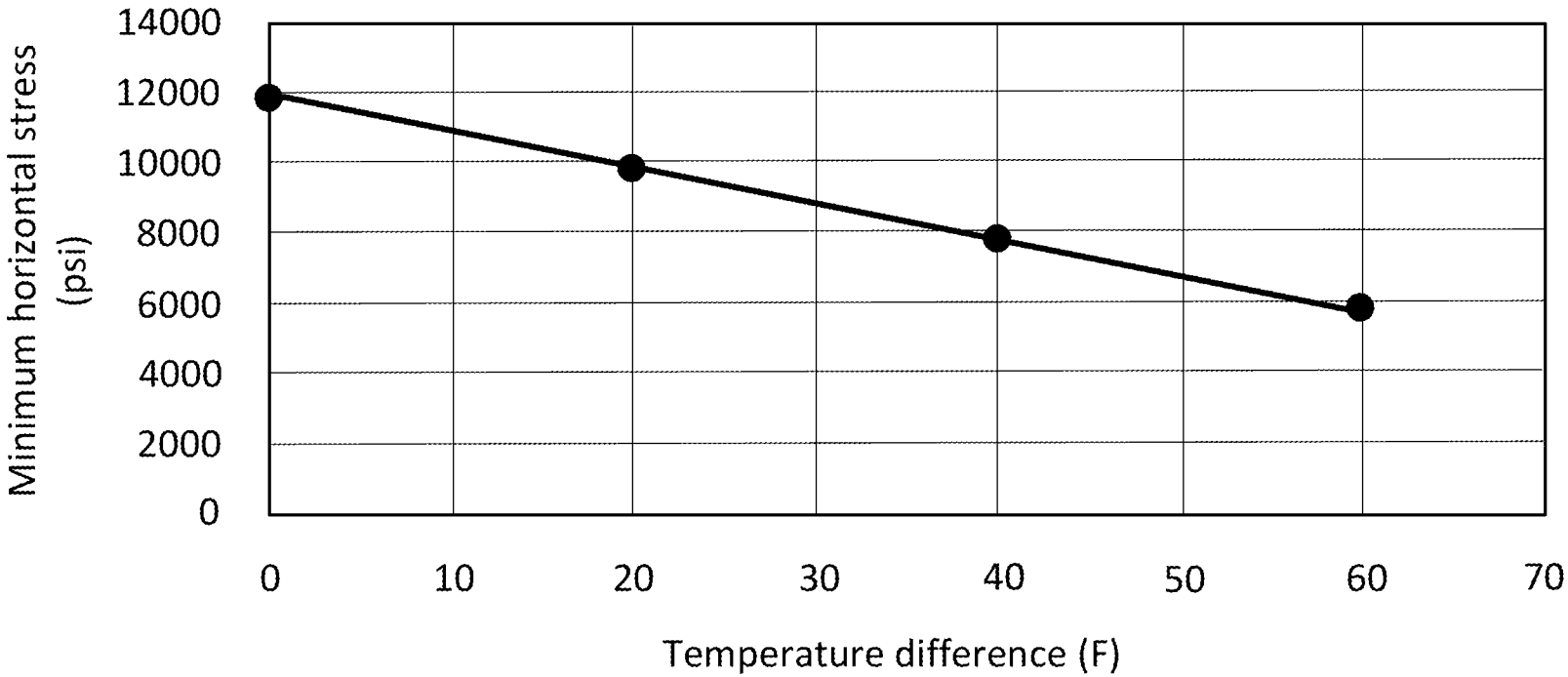
FIG. 6 is a plot of the total minimum horizontal stress vs. temperature difference between the formation and the liquid.

FIG. 6 is a plot of the total minimum horizontal stress of a simulated formation vs. the temperature difference between the fluid and the formation. If high breakdown pressure is encountered during fracturing operations, the pressure required for effective fracturing is much higher than the total minimum horizontal stress. This figure illustrates the reduction in total minimum horizontal stress (and a resulting reduction in breakdown pressure) that can be provided by cooling. The simulated formation simulates a tight gas reservoir with a permeability of 0.06 and and a porosity of 6%. The formation temperature is 300° F. and the minimum horizontal stress gradient is 0.9 psi/ft. As simulated, temperature differences between the fluid and the formation change the minimum horizontal stress. For example, the simulated formation indicates 12,000 psi of minimum horizontal stress that needs to be overcome to fracture the formation when there is no temperature difference between the fluid and the formation. Meanwhile, the simulated minimum horizontal stress of the formation drops down to 6,000 psi when there is a 60° F. difference between the fluid and the formation. This is a significant reduction in the minimum horizontal stress value which can be quite easily overcome within the pressure limits of the wellbore tubulars or pumps.

Figure 7:
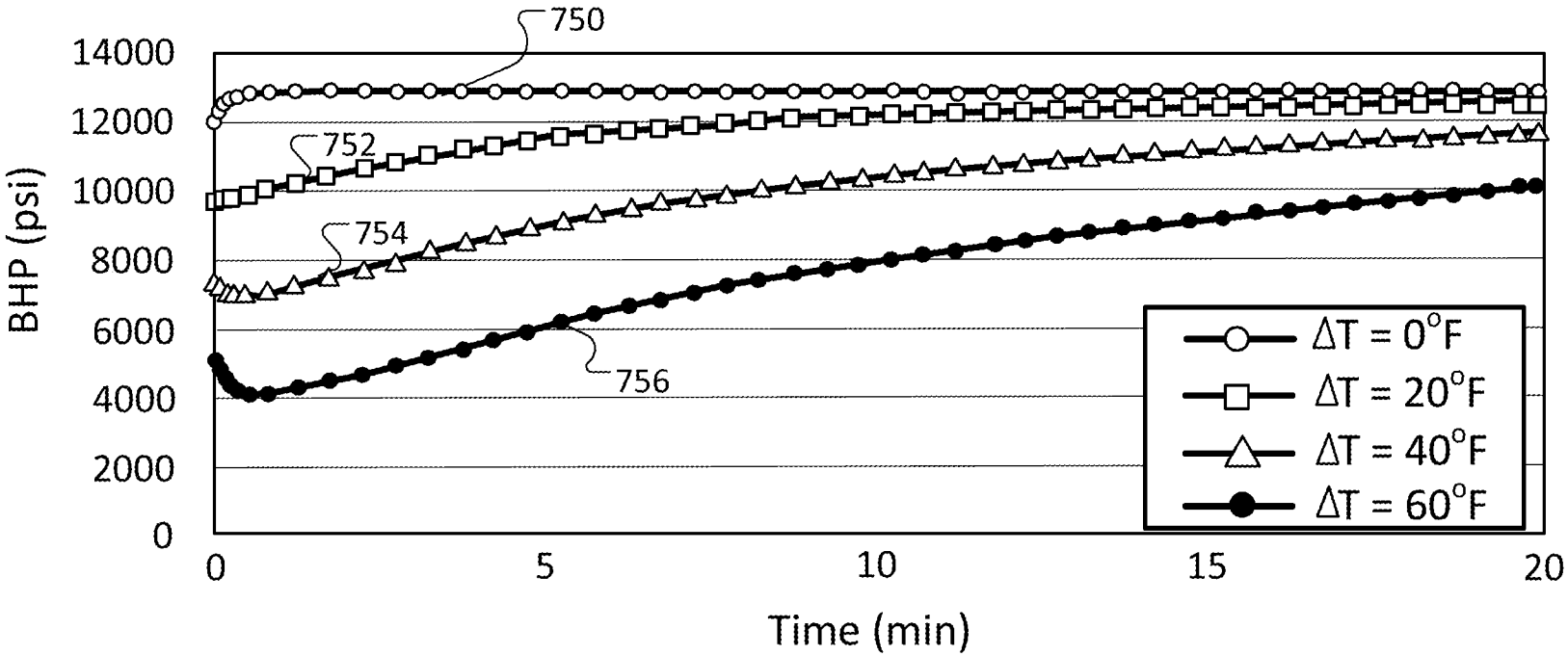
FIG. 7 is a plot of a bottom hole pressure vs. temperature difference between the formation and the liquid.

FIG. 7 is a plot of the minimum bottom hole treating pressure (the pressure at the bottom of the well) required to initiate a fracture in the simulated formation of FIG. 6. The line 750 illustrates the bottom hole pressure required to initiate a fracture in the formation with a 0° F. difference between the fluid and the formation as a function of time. The line 752 illustrates the bottom hole pressure required to initiate a fracture in the formation with a 20° F. difference between the fluid and the formation. The line 754 illustrates the bottom hole pressure required to initiate a fracture in the formation with a 40° F. difference between the fluid and the formation. The line 756 illustrates the bottom hole pressure required to initiate a fracture in the formation with a 60° F. difference between the fluid and the formation. This simulation indicates that increasing the temperature difference between the fluid and the formation decreases the pressure required to initiate a fracture in the formation. This patent provides a method to deliver super-cooled injection fluids that can deliver the high temperatures differentials modeled in FIGS. 6 and 7.

Generally, fluid that is injected from the surface heats up as it flows to the bottomhole perforations. It is therefore necessary to cool down the surface fluid as much as practically possible so that when it gets to the bottom hole it still has a large temperature contrast between it and the reservoir. Note that a super-cooled fluid can be pumped at a high volume and/or for a long time to affect a significant temperature difference in the bottomhole.

Figure 8:
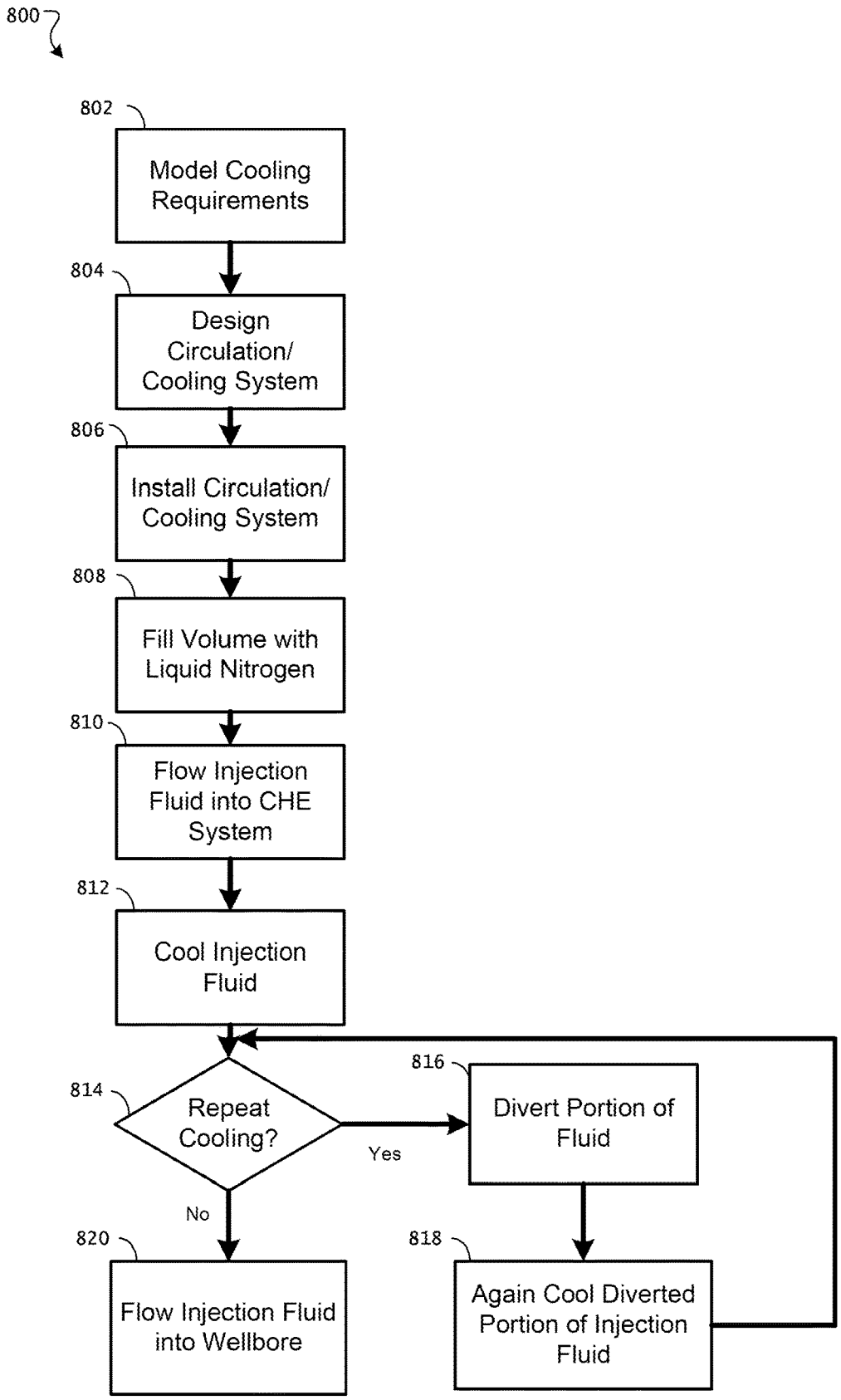
FIG. 8 is a process flow diagram of a method of cooling the injection fluid in accordance with an embodiment of the present disclosure.

FIG. 8 is a process flow diagram of a method 800 of cooling a formation in accordance with an embodiment of the present disclosure. Method 800 is described with reference to the discussed injection fluid injected in a wellbore prior to the main fracturing operation; however, it will be understood some or all of the steps of the method can be applicable to other well system types and other well fluids. Method 800 begins at when cool-down temperature requirements for wellbore fluid (such as the injection fluid) in a well system of a specified configuration (including drilling depth and expected downhole temperatures) are to be modeled (802). Such modeling can be done using, for example, an Advanced Thermodynamics Temperature Simulator. A suitable surface cooling system including a CHE system using liquid nitrogen for fluid cooling is designed (804) based on the modeling, including cooling capacity, valving, storage tanks, flow rates, volumes and other components and parameters. The CHE system can be CHE system 118 as described above (including but not limited to any of embodiments 118*a*, 118*b*, or 118*c*), including an injection fluid conduit and an outer jacket. An inner surface of the outer jacket can least partially defines an interior volume within which the drilling fluid conduit is at least partially disposed.

The circulation and CHE systems are assembled and connected to the well system (806), with the CHE system positioned, for example, at a surface location separate from a wellhead of the wellbore, and the interior volume is at least partially defined by an inner surface of an outer jacket of the CHE system, as described above. An interior volume of a CHE system is filled with liquid nitrogen (808). In some embodiments, filling the interior volume with liquid nitrogen occurs after the fluid flow is initiated in the wellbore, or another suitable time.

Injection fluid is pumped to the wellbore through a cooling fluid conduit of the CHE system at least partially disposed within the interior volume (810). The injection fluid flowing through the cooling fluid conduit is cooled by heat exchange with the liquid nitrogen across a wall of the drilling fluid conduit (812).

In some embodiments, the operator can determine (based on temperature measurements or other data or information) whether repeated cooling of the injection fluid is desired or necessary, prior to pumping the injection fluid to the wellbore (814). If it is determined that such repeated cooling is necessary or desirable, at least a portion of the injection fluid is diverted (for example, by a diverter that is a component of or fluidically connected to the insulated circulating tank) to an intermediate recirculating pump (816). The diverted portion is again cooled in the CHE system (818). The operator again can determine (based on temperature measurements or other data or information) whether repeated cooling of the injection fluid is desired or necessary (814).

If it is determined that no further cooling of the injection fluid is desirable or necessary, the cooled portion is pumped into to the wellbore (820).

In some embodiments, the method may not include a repeated-cooling step and, in such embodiments, all of the injection fluid flowed through the injection fluid conduit is pumped into the wellbore.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, or in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Accordingly, the previously described example implementations do not define or constrain the present disclosure. Other changes, substitutions, and alterations are also possible without departing from the spirit and scope of the present disclosure.

What is claimed is:

1. A method of fracturing a subsurface formation, the method comprising:

super-cooling liquid carbon dioxide to a temperature between −60° F. to −70° F. using liquid nitrogen;

pumping the super-cooled liquid carbon dioxide down a wellbore to create fractures in the subsurface formation; and pumping fracturing fluid containing a proppant down the wellbore after pumping the super-cooled liquid carbon dioxide down the wellbore, wherein super-cooling the liquid carbon dioxide includes flowing the liquid carbon dioxide through an inner tube of an in-line heat exchanger, the inner tube fluidly connected to tubing, the inline heat exchanger further comprising:

an outer tube extending around the inner tube, the outer tube having an upstream end and a downstream end; and a middle tube disposed around the inner tube and disposed inside the outer tube;

first end walls extending between the inner tube and the middle tube, the first end walls, the inner tube, and the middle tube defines a sealed chamber;

second end walls extending between the outer tube and the middle tube, the second end walls, the outer tube, and the middle tube defining a jacket chamber with an inlet for the liquid nitrogen at the upstream end of the outer tube and an outlet at the downstream end of the outer tube.

2. The method of claim 1, further comprising holding the super-cooled liquid carbon dioxide in a chilled holding tank fluidly connected to the in-line heat exchanger after super-cooling the liquid carbon dioxide.

3. The method of claim 2, further comprising continuing to cool the super-cooled liquid carbon dioxide within the chilled holding tank.

4. The method of claim 2, further comprising circulating the super-cooled liquid carbon dioxide repeatedly between the in-line heat exchanger and the chilled holding tank.

5. The method of claim 1, wherein the liquid carbon dioxide has a surface pressure in a range of 60 psi to 100 psi.

6. The method of claim 1, wherein the inner tube includes fins extending radially outward along a surface of the inner tube.

7. The method of claim 1, further comprising filling the sealed chamber with water.

* * * * *